US005113633A

United States Patent [19]

Helms et al.

[11] Patent Number: 5,113,633

[45] Date of Patent: May 19, 1992

[54] ASSEMBLY FOR PREPARING BUSHY PLANTS FOR PACKING

[75] Inventors: Bernd Helms, Offenseth-Sparrieshoop; Reiner Peters, Ellerhoop; Peter Hoppe, Offenseth-Sparrieshoop, all of Fed. Rep. of Germany

[73] Assignee: W. Kordes' Sohne Rosenschulen GmbH & Co. KG, Offenseth-Sparrieshoop, Fed. Rep. of Germany

[21] Appl. No.: 585,146

[22] PCT Filed: Feb. 9, 1990

[86] PCT No.: PCT/EP90/00214

§ 371 Date: Oct. 4, 1990

§ 102(e) Date: Oct. 4, 1990

[87] PCT Pub. No.: WO90/09317

PCT Pub. Date: Aug. 23, 1990

[30] Foreign Application Priority Data

Feb. 10, 1989 [DE] Fed. Rep. of Germany ..... 3904045

[51] Int. Cl.[5] ..... B65B 27/10; B65B 63/00

[52] U.S. Cl. ..... 53/513; 53/515; 53/582; 198/803.9; 99/643

[58] Field of Search ..... 53/513, 515, 582; 99/643; 198/803.9

[56] References Cited

U.S. PATENT DOCUMENTS

| | | | |
|---|---|---|---|
| 2,180,349 | 11/1939 | De Back | 53/515 |
| 4,095,391 | 6/1978 | Anguiano | 53/515 |
| 4,262,944 | 4/1981 | Branch | 53/515 X |
| 4,885,898 | 12/1989 | Khurgin | 53/513 |

*Primary Examiner*—John Sipos

*Attorney, Agent, or Firm*—Brumbaugh, Graves, Donohue & Raymond

[57] ABSTRACT

At least one binder means (40,42) for tying together projecting parts (T,W) of the plants (p) each held in a retainer (30) and at least one cutter means (44,46) for shortening projecting parts (T,W) of the plants (P) are arranged beside a conveyor (12) which comprises retainers (30) for a plant (P) each. Each retainer (30) includes at least one upwardly open fork (26,28) into which a plant (P) can be put and at least one bow (64) to press down the plant (P). Each bow (64) is pivotable about a transverse axis, is biased by a spring (73) in the sense of an opening movement, and is adapted to be locked in various closing positions by a ratchet mechanism (66,68). In a starting range of the conveyor (12) there is an actuating member (74) which acts on a control member (72) at each bow (64) so as to pivot it in closing direction. In a final range of the conveyor (12) there is a control member (80) for release of the ratchet mechanism (66,68).

8 Claims, 7 Drawing Sheets

ASSEMBLY FOR PREPARING BUSHY PLANTS FOR PACKING

The invention relates to an assembly for preparing bushy plants, especially rose plants for packing.

Such plants, which cultivators ever more often pack and ship individually to customers, usually are too bulky in the condition as gathered and freed from soil to be put directly into a package. Therefore, it is customary to tie such plants together at the shoots and roots. To accomplish that, binder apparatus are known which are used in such a way that a person first holds each individual plant into the apparatus, with one plant end leading, such as the roots, releases a first tying, then pulls the plant out of the apparatus, turns it around, again holds it into the apparatus with the other end leading, releases the second tying, and finally deposits the plant at a place where it can be reached or is moved by an intermediate conveyor so to be reached by another person who operates a cutter means to prune the shoots and the roots. It is cumbersome and not without risk to work on binding and cutting machinery, particularly so if the plants have unwieldy roots and shoots.

It is, therefore, the object of the invention to prepare bush and shrub plants for packing with little use of human labor and without endangering them.

The object is met, in accordance with the invention, by an assembly, comprising a conveyor which includes retainers for a plant each, at least one binder means for tying together projecting parts of the plants each held in a retainer, and at least one cutter means for shortening projecting parts of the plants each held in a retainer.

Projecting parts of the plant are understood to be the roots and/or shoots thereof. It is not always necessary to bind both the roots and the shoots. The roots need not be bound if they are held together as if tied in a subsequent working stage in which the plants are packed. On the other hand, it is conceivable that the shoots of the plants need not be bound because they will be cut back subsequently on the assembly according to the invention to become rather short. In such events it is sufficient for the assembly according to the invention to comprise but a single binding device. For much the same reasons, it may be sufficient if the assembly according to the invention comprises only one cutting device to prune either the roots or the shoots of the plant. In general, however, two cutter means are provided, one to cut back the roots and the other one for the shoots of the plants.

Generally speaking, all the person has to do who works on an assembly according to the invention, is to place plants into one each of the retainers at the beginning of the conveyor. All the rest then can be done automatically, with the usual design of the binding and cutting apparatus disposed along the conveyor.

Advantageous further developments of the invention appear from the subclaims.

Embodiments of an assembly according to the invention will be described in greater detail below with reference to diagrammatic drawings, in which.

Figure 1:
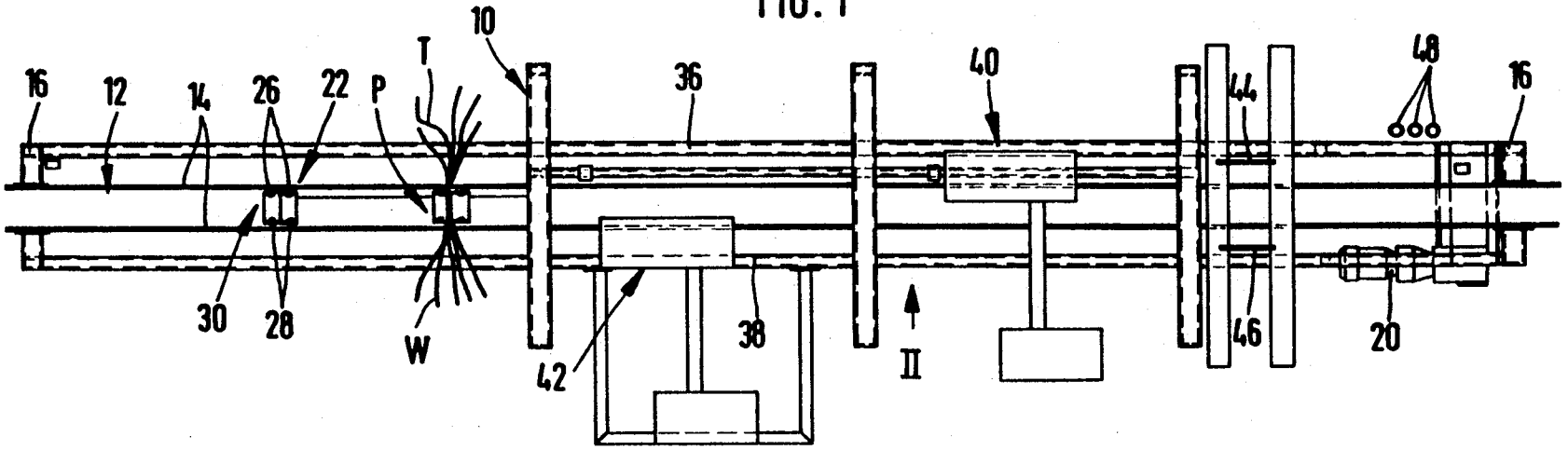
FIG. 1 is the plan view of a first assembly according to the invention.
Figure 2:
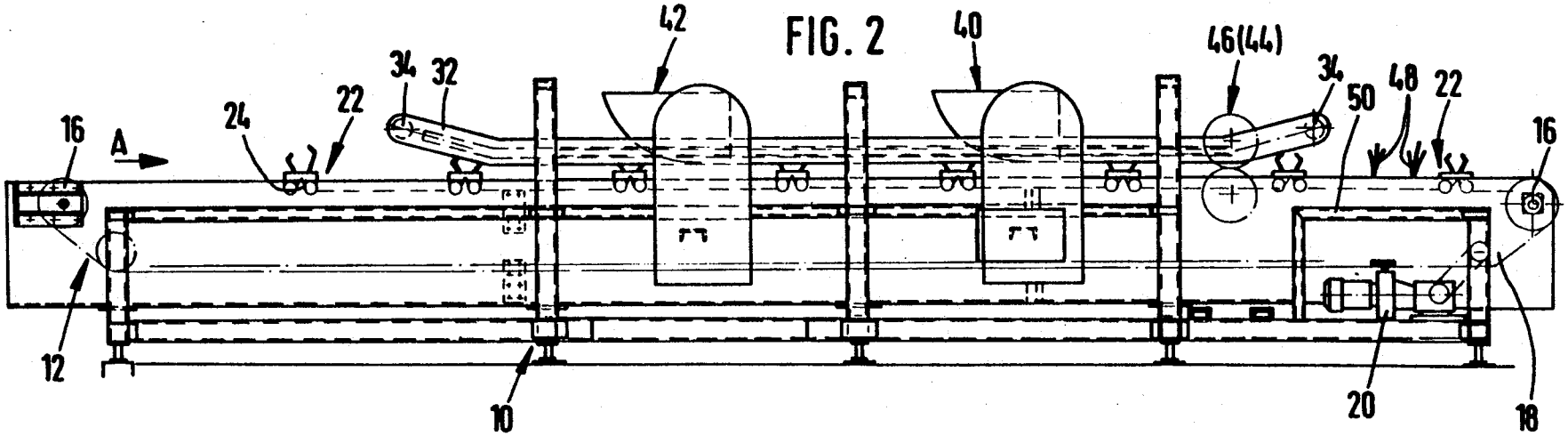
FIG. 2 is the side elevational view in the direction of arrow II in FIG. 1.
Figure 3:
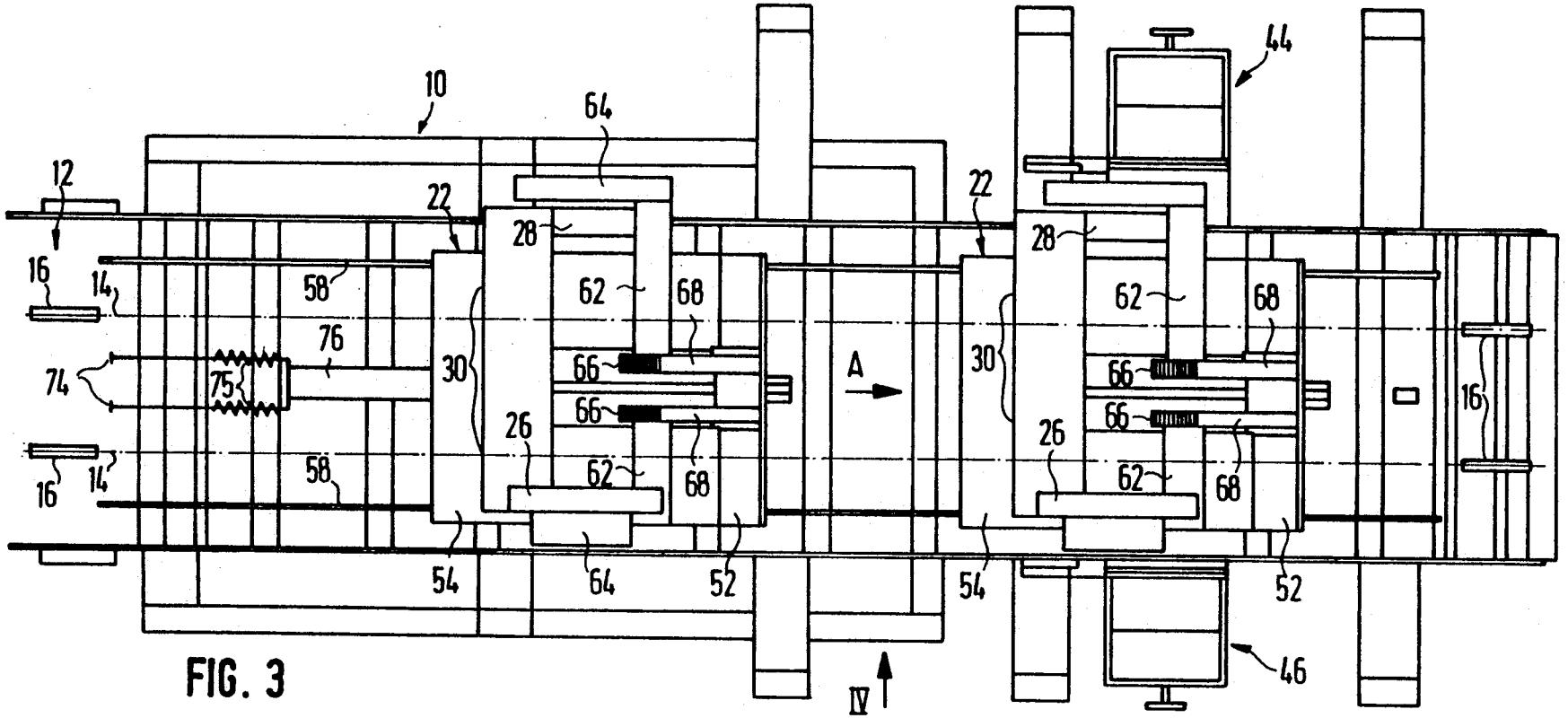
FIG. 3 is the plan view of a second assembly according to the invention.
Figure 4:
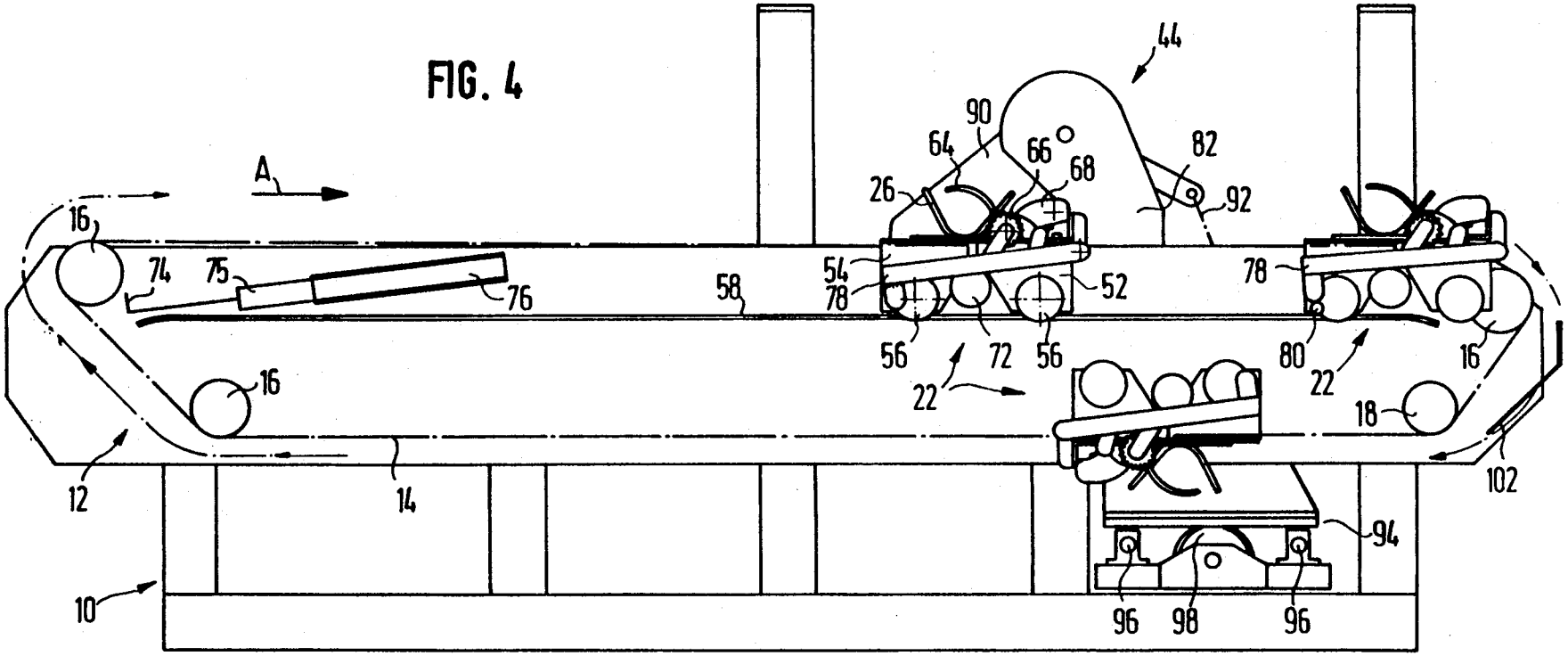
FIG. 4 is the side elevational view in the direction of arrow IV in FIG. 3.
Figure 5:
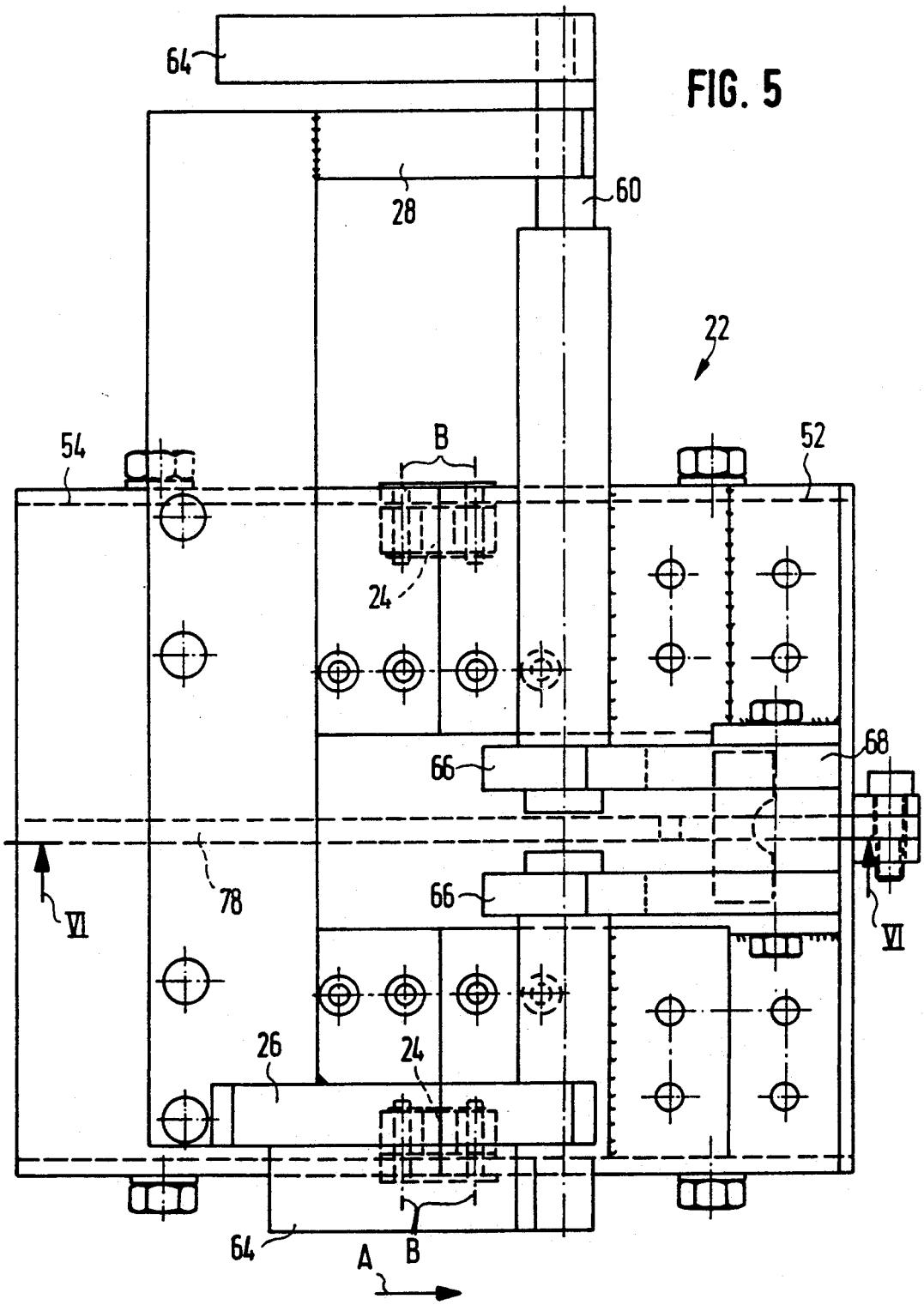
FIG. 5 is an enlarged cutout of FIG. 3, showing further details.
Figure 6:
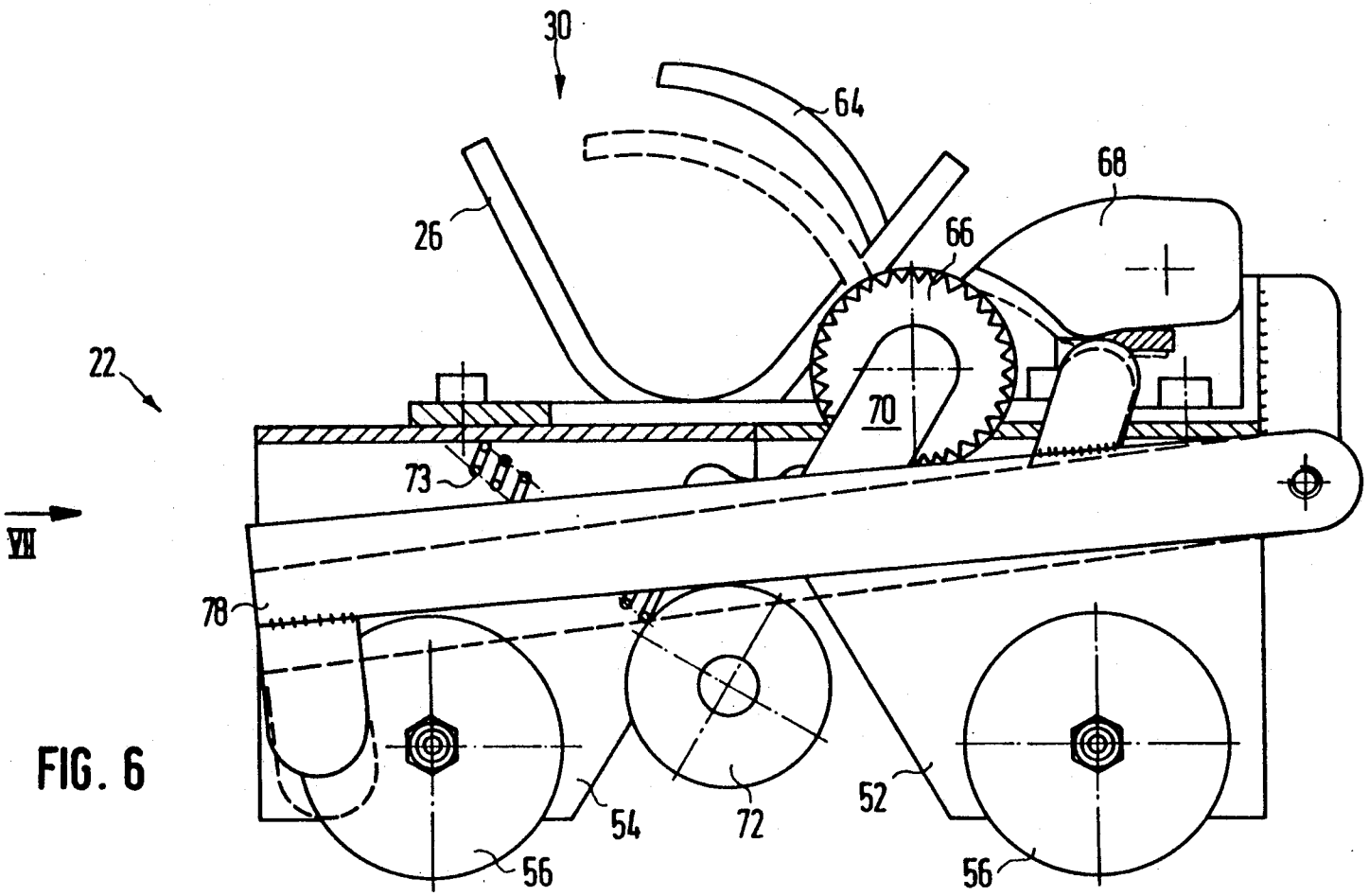
FIG. 6 is the side elevational view belonging to FIG. 5, partly in section in the vertical plane VI—VI.
Figure 7:
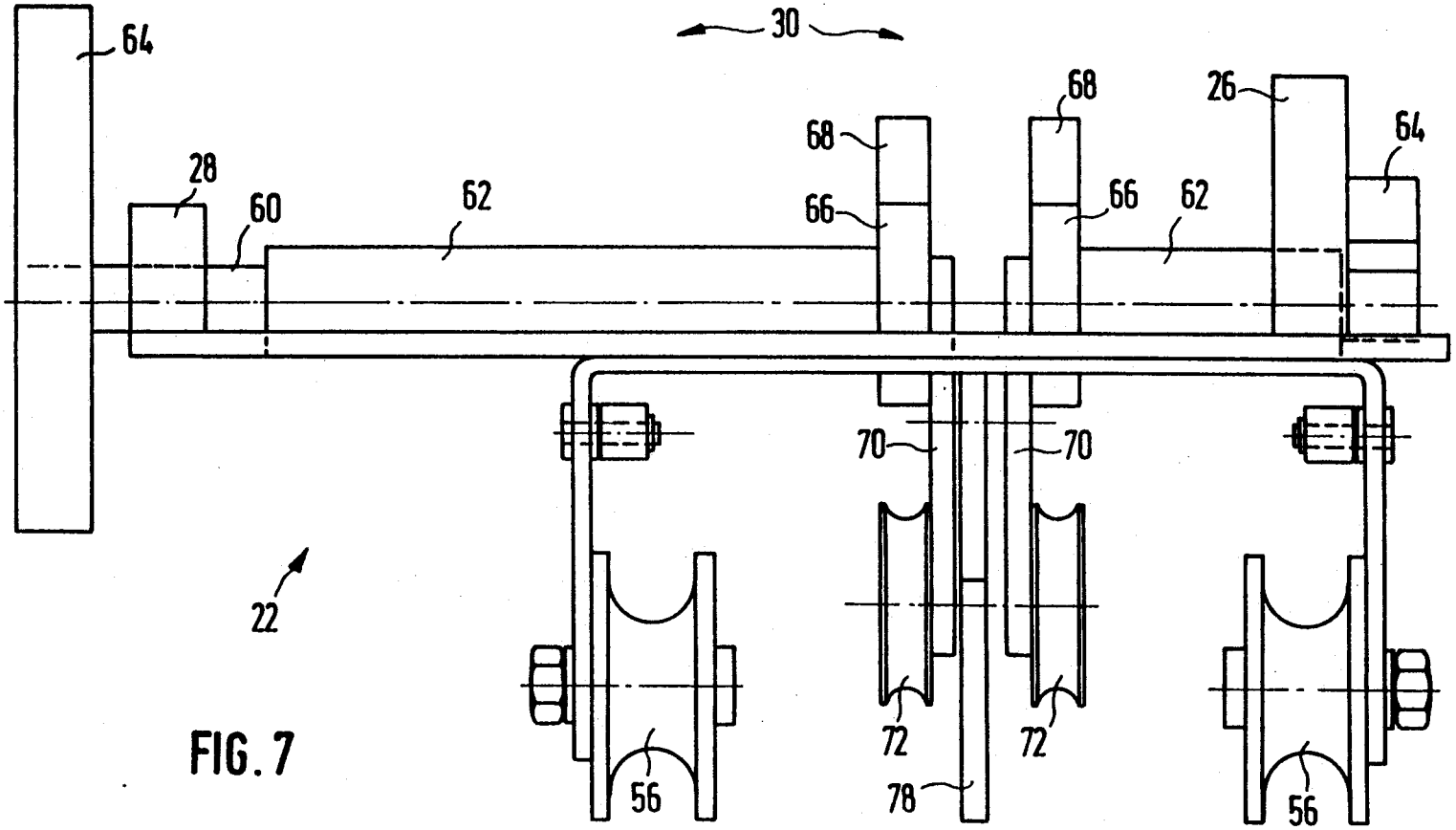
FIG. 7 is the view in the direction of arrow VII in FIG. 6.
Figure 8:
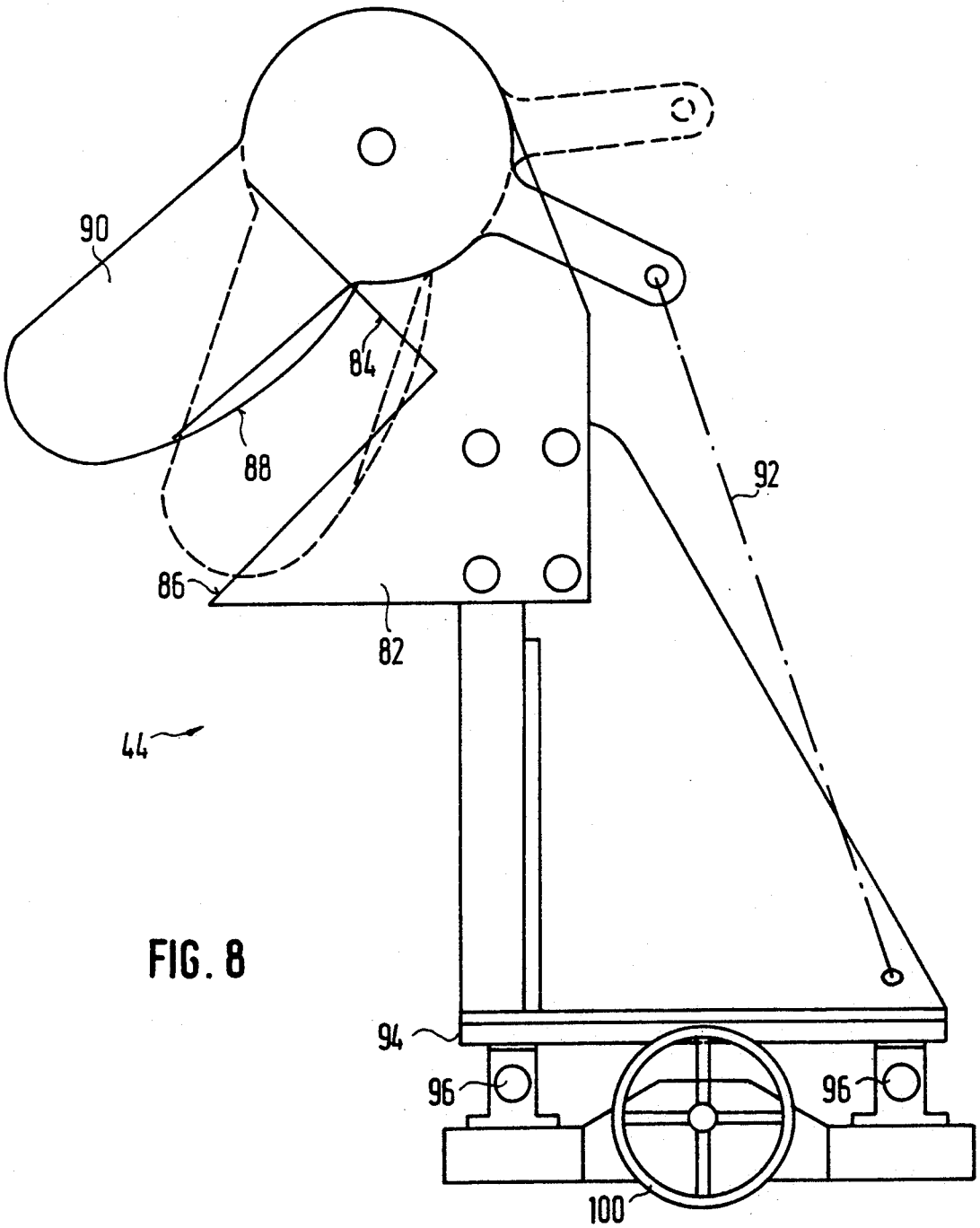
FIG. 8 is an enlarged cutout of FIG. 4.

The assembly illustrated in FIGS. 1 and 2 comprises an elongated machine frame 10 supporting an endless conveyor 12. In the embodiment shown, the conveyor 12 consists essentially of a pair of parallel chains 14 running around return rollers 16 and drive rollers 18 and being driven in common in the direction of arrow A by a geared engine 20. The two chains 14 are interconnected at regular intervals by carriages 22 which are divided in a central transverse plane each where they are each provided with a double joint 24 comprising two horizontal hinge axes B which extend transversely of the longitudinal direction of the conveyor 12.

According to FIGS. 1 and 2, each carriage 22 supports two upwardly open forks 26 and 28 side by side, the forks together presenting a retainer 30 for a plant P. Fork 26 is intended to receive the shoots T, while fork 28 is destined to take up the roots W of the plant P. Each fork 26 and 28 is formed of two halves which are separated by the central joint 24 and which always move away from each other when the chains 14 run around return rollers 16. That facilitates putting a plant P each into the retainers 30 at the beginning of the conveyor 12. The forks 26 and 28 which subsequently close around the shoots T and the roots W, respectively, then hold the plant P throughout its entire path clamped along the upper run of the conveyor 12 and release the plant at the rear return rollers 16 only where the plant may then drop into a receptacle or on to another conveyor.

Above the conveyor 22 and substantially in parallel with it, according to FIG. 2, an endless belt 32 is passed around return rollers 34 in such a way as to press down the plants P in the area between the forks 26 and 28 in order that they may not fall out of the forks when the devices to be described below come to act. The endless belt 32 revolves in synchronism with the chains 14 and may also be driven by the geared engine 20 for this purpose.

Regardless of how the forks 26 and 28 or the like are designed and whether, accordingly, the endless belt 32 is needed or not, a pair each of endless belts 36 and 38, respectively, may be arranged at either side of the conveyor 12, slightly diverging in the conveying direction. They also revolve in synchronism with the chains 14 and clamp the ends of the shoots T or roots W of the plants P lying on the carriage 22 and, above all, they stretch the roots for the subsequent operating steps.

According to FIGS. 1 and 2, a respective binder means 40 and 42 of per se known design is arranged at either of the longitudinal sides of the conveyor 12 for binding of the shoots T and roots W, respectively. Further downstream in conveying direction a respective cutter means 44 and 46 is arranged at either of the longitudinal sides of the conveyor 12 for pruning of the shoots T and roots W, respectively. According to FIGS. 1 and 2, each of the two cutter means 44 and 46 consists of a pair of fine-toothed circular saws.

Finally, according to FIGS. 1 and 2, a group of hot wax fountains 48 are provided near the end of the conveyor 12 in an area over which the pruned shoots T move and they are directed substantially vertically upwardly from nozzles in a collecting pan 50, wetting the shoots T, and thereafter dripping back into the collecting pan 50. The wax forming the hot wax fountains 48 at a temperature which is still tolerable by the shoots T, solidifies before the plants P have left the area above the collecting pan 50 and then presents a protective coating which prevents the shoots T from drying out.

In the case of the assembly illustrated in FIGS. 3 to 8 the conveyor 12 with its carriages 22 is substantially of the same design as in FIGS. 1 and 2. The endless belts 32, 36, and 38 are missing because the plants P are held in the retainers 30 in a manner which differs from FIGS. 1 and 2 and which will be described below. Neither of the two binder means 40 of FIGS. 1 and 2 is shown in FIGS. 3 to 8 since it seems that any detailed explanation may be dispensed with as such binder means are known. In an actually made assembly according to FIGS. 3 to 8 there is only one binder means and it serves to bind the shoots T of the plants P, whereas the roots remain untied. Finally, the two cutter means 44 and 46 according to FIGS. 3 to 8 are designed differently from FIGS. 1 and 2, as will be described below.

According to FIGS. 3 to 8, as already indicated with reference to FIGS. 1 and 2, each of the carriages 22 consists of front and rear halves 52 and 54, respectively, which are interconnected by double joints 24 having transversely disposed hinge axes B. A pair each of travelling wheels 56 are supported at the two halves 52 and 54 of each carriage 22, and during forward movement of the carriages 22 in the direction of arrow A they run on rails 58 at the machine frame 10.

At the front half 52 of each carriage 22 two transversely disposed shafts 60 are supported, mutually aligned, in a bearing 62 each so as to be rotatable but axially fixed. At the outer end of each shaft 60, with respect to the corresponding carriage 22, a bow 64 is fixed to hold down a plant P placed in the forks 26 and 28. A locking wheel 66 formed with a sawtooth-like toothing is fixed at the other end of each shaft 60. The locking wheels 66 cooperate with a pawl 68 each, supported at the front half 52 of the carriage in such a way that it tends to engage in the corresponding locking wheel 66 under the action of its own weight, aided by a spring, if necessary.

A closing lever 70 carrying at its free end a control member 72 embodied by a roll, is fixed to each of the locking wheels 66. Each of the closing levers 70 and thus also the corresponding bow 64 is biased by a spring 73 indicated in FIG. 6 in the sense of pivoting upwardly in opening direction. To close the bows 64, actuating members 74 in the form of pulling hooks are disposed in a starting range of the conveyor 12. They are each connected to a pneumatic piston and cylinder unit 76 by a tension spring 75. Retraction of the piston and cylinder unit 76 will cause the rolls 72 of a carriage 22, which is in a starting position, to be pulled forward by an adjustable force each. As a consequence, each of the closing levers 70 exerts a torque in counterclockwise sense, based on the presentation in FIG. 4, on the corresponding shaft 60.

According to FIGS. 3 to 8, each carriage 22 supports only one complete fork 26 and, instead of the other fork, a take-up element 28, both being secured to the rear half 54 of the carriage.

A release lever 78 is supported at the front half 52 of each carriage 22. It is pivotable in a vertical longitudinal plane of the conveyor 12 and normally held in a position in which it has no effect, being inclined obliquely downwardly to the rear. In a final range of the conveyor 12 there is a control member 80, embodied by a stationarily supported roll, on which the release lever 78 runs up so as to be swung upwardly. Consequently the two pawls 68 of the corresponding carriage 22 are swung in upward direction. That releases the two corresponding locking wheels 66 so that the two bows 64 of the corresponding carriage 22 are pivoted upwardly by the corresponding spring 73 into their open position.

Each of the two cutter means 44 and 46 comprises a stationary knife 82 with two straight blades 84 and 86 which converge in the direction of movement A of the conveyor 12 and include a right angle between them. An arcuate blade 88 of a pivotable knife 90 cooperates with these two straight blades 84 and 86, the pivotable knife being supported at the fixed knife 82 for pivoting in a vertical longitudinal plane of the conveyor 12 and operable by a pneumatic piston and cylinder unit 92 which is only indicated.

Each of the two severing means 44 and 46 is arranged on a carriage 94 adapted to be pushed back and forth between an adjustable work position in the direct vicinity of the conveyor 12 and a position of rest at a greater distance from the conveyor by means of a pneumatic piston and cylinder unit 98 on a pair of horizontal guide rods 96 extending transversely of the direction of movement A. A handwheel 100 is provided to adjust the work position.

When the assembly described above is in operation, a plant P lying in crosswise direction is put into the fork 26 and the take-up element 28 of each carriage 22 at the beginning of the conveyor 12 as long as the two bows 64 are in their open position. The introduction of the plant P is ascertained by a sensor (not shown) of conventional kind arranged at the loading place. It causes the piston and cylinder unit 76 to pull the actuating members 74 forwardly. Consequently the bows 64 are closed more or less by their closing levers 70 so that the plant P that was introduced is held by the bows 64 with sufficient forces which, however, still are harmless.

During the further movement of the conveyor 12, taking place stepwise, the respective plant P will reach a position at which its shoots T protrude into the binder means 40 and are tied by the same. After one of the further steps of the conveyor 12 the plant P will reach the two cutter means 44 and 46 which will prune the shoots T and the roots W. On this occasion the angular arrangement of the fixed blades 84 and 86 prevents the shoots T or roots W from evading the movable blade 88.

As soon as the carriage 22 with the plant P in question reaches the final range of the conveyor 12, the release lever 78 runs up on the control member 80 and, as a result, the plant P becomes released by the bows 64 and falls out of the fork 26 and the take-up element 28 as soon as the respective carriage 22 moves down at the end of the conveyor 12. At that point there is a wiper device 102 which makes sure that the plant P does separate from the carriage 22 and falls onto another conveyor (not shown) or into a receptacle.

What is claimed is:

1. An assembly for preparing bushy plants for packing, comprising a conveyor (12) which includes a plurality of retainers (30), each retainer (30) acting to retain one plant (P), and comprising at least one upwardly open fork (26, 28) in which the plant (P) can be placed and at least one bow (64) to press down the plant (P), each bow (64) being pivotable about a transverse axis, biased by a spring (73) in the sense of an opening movement, and adapted to be locked in different closing positions by a ratchet mechanism (66, 68), with each bow (64) connected to a control member (72), and an actuating member (74) being disposed in a starting range of the conveyor (12) and acting on the control member (72) to pivot the corresponding bow (64) in a closing direction, at least one binder means (40, 42) for tying together projecting parts (T, W) of each plant (P) held in a retainer (30), and at least one cutter means (44, 46) for shortening projecting parts (T, W) of each plant (P) held in a retainer (30).

2. The assembly as claimed in claim 1, characterized in that a control member (80) is arranged in a final range of the conveyor (12) to release the ratchet mechanism (66, 68).

3. The assembly as claimed in claim 1 or claim 2, in which the severing means (44, 46) each comprise a stationary knife (82) with two blades (84, 86) which converge in the direction of movement of the conveyor (12) as well as a movable knife (90) which cooperates with those two blades (84, 86).

4. The assembly as claimed in claim 1, in which the severing means (44, 46) each are mounted on a carriage (94) which is movable back and forth transversely of the direction of movement (A) of the conveyor (12) between an operative position adjacent the conveyor (12) and an inoperative position remote from the same.

5. The assembly as claimed in claim 4, characterized in that the operative position is adjustable.

6. The assembly as claimed in claim 1, in which a collecting pan (50) is disposed beside the conveyor (12) from which pan hot wax fountains (48) start for wetting the shoots (T).

7. The assembly as claimed in claim 1, in which the actuating member (74) is connected by connecting means to a pneumatic piston and cylinder unit (76).

8. The assembly as claimed in claim 7, in which the connecting means is a tension spring (75).

* * * * *